US007100228B2

(12) United States Patent
Polevoy et al.

(10) Patent No.: US 7,100,228 B2
(45) Date of Patent: Sep. 5, 2006

(54) SNAP ON PROTECTIVE MEMBERS FOR BED FRAMES

(75) Inventors: Richard S. Polevoy, Teaneck, NJ (US); Howard Scott Ryan, Skaneateles, NY (US); Paul Eric Carlson, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 0 days.

(21) Appl. No.: 10/827,875

(22) Filed: Apr. 20, 2004

(65) Prior Publication Data

US 2004/0194217 A1 Oct. 7, 2004

Related U.S. Application Data

(63) Continuation of application No. 09/997,389, filed on Nov. 29, 2001, now abandoned.

(51) Int. Cl.
*A47C 21/00* (2006.01)

(52) U.S. Cl. ..... 5/663; 5/424

(58) Field of Classification Search ..... 5/663, 5/424, 200.1; 248/345.1; 312/265.6
See application file for complete search history.

(56) References Cited

U.S. PATENT DOCUMENTS 3,546,725 A * 12/1970 Tambascio ..... 5/200.1
3,824,638 A * 7/1974 Bogar, Jr. ..... 5/181
4,109,887 A * 8/1978 Wakeland, Jr. ..... 5/678
4,443,508 A * 4/1984 Mehl ..... 428/122
6,076,212 A * 6/2000 Feld ..... 5/663

* cited by examiner

*Primary Examiner*—Patricia L. Engle
*Assistant Examiner*—Fredrick Conley
(74) *Attorney, Agent, or Firm*—Klauber & Jackson

(57) ABSTRACT

A protective member, preferably an extruded plastic is used to enclose, at least partially, a component of a bed frame so as to provide protection against inadvertent injury to a user striking the otherwise sharp edges of the component. The components are normally a side rail and a center rail and the protective member is snapped fitted to that component by the presence of curved lips that at least partially encircle the external edges of the component. There are also ribs formed in the protective member and which position the protective member a predetermined distance away from the particular component. In the case of the center rail, the protective member is spaced away from the upper surface of the center rail so as to compensate for the lower position of that surface with respect to the head and foot cross members so that a box spring resting upon the side rails and the center rail is supported evenly and does not bow at its center due to a spatial difference between the center rail and the cross members.

13 Claims, 4 Drawing Sheets

SNAP ON PROTECTIVE MEMBERS FOR BED FRAMES

This application is a continuation of Ser. No. 09/997,389 abondened Nov. 29, 2001.

BACKGROUND OF THE INVENTION

The present invention relates to a bed frames, and, more particularly, to protective members that can be readily assembled to certain components of a bed frame.

In general, bed frames are comprised of a pair of side rails and a plurality of cross members that span between the side rails in order to assembly and complete the bed frame structure. The side rails are normally L-shaped angle irons that have a vertical leg forming the exterior of the bed frame and a horizontal leg that extends inwardly with respect to the bed frame at the lower extremity of the vertical leg. In addition, there is also normally a center rail affixed to the cross members and which parallels the two side rails and is generally centered between those side rails. The center rail can be made up of two L-shaped angle irons that are attached together back to back such that there is a double thickness downwardly directed vertical leg and two coplanar horizontal legs that form an upper, planar surface that is double the width of an individual angle iron horizontal leg.

One of the difficulties with such bed frame construction is, however, that the exterior surface that is the visible to the user and other persons is simply the exterior vertical leg of the side rails and that does not present a particular pleasing appearance. In addition to the appearance, there are generally sharp edges on that external vertical leg and which can be encountered by the shins or legs of the persons and cause injury and even the flat vertical surfaces themselves of the side rails are hazardous, being comprised of iron, and therefore very unforgiving if encountered or struck by a person. Thus, it would be advantageous to have a means of improving the exterior appearance of the side rails as well as to lessen the potential injury occasioned by a person hitting that external vertical leg or planar surfaces of the side rails.

In addition, since these side rails are of an iron material having sharp edges, there is a danger to inanimate objects, such as when moving the bed frame of a completed bed, there is always a possibility of damaging walls, other furniture and the like by running the bed frame into such objects. Lastly, with the aforedescribed sharp edges, there is a distinct likelihood of tearing the material used in the box spring when the box spring is added to the bed frame or removed therefrom.

One type of protective member is shown and described in U.S. Pat. No. 6,076,212 of Feld and which utilizes a protective member comprised of a compressible material that is shaped into a specific configuration to shield the steel rail from causing injury caused by the impact of the steel side rail by a person. The particular protective member of Feld, however, requires a cushion material having a certain predetermined cross section all along the length of the side rail and is a fairly difficult component to produce with the necessary tolerances, particularly with the protective member constructed of the resilient material having varying thickness and its assembly to the particular bed frame component would not be particularly secure. In addition, the use of a resilient, relatively thick material requires a considerable amount of material in making up the protective member of Feld.

There is a further problem, however, with respect to the center rail. Its construction and its location is less of an issue as to being inadvertently encountered by a person and thereby cause injury as it is in having the height of the upper planar horizontal surface correctly and horizontally aligned with respect to the cross members. In the assembly of a bed frame, the cross members are normally each made up of two cross pieces that are normally pivotally affixed to the side rails at or generally near the ends thereof and that ability to pivot provides considerable convenience in the storage and shipping of a bed frame. In the assembly of the bed frame on site, the cross pieces are rotated to a position generally at right angles to the side rails and the oppositely, inwardly directed cross pieces are affixed together in an overlapping relationship to form a cross member and creating a double thickness of the horizontal legs of the L-shaped angle irons of the cross members at the vicinity of the center of the bed frame.

The center rail is thereafter affixed to that double layer of horizontal legs of the cross members and the upper surface of the center rail abuts against the lower surface of the double layered interconnection between opposite cross pieces. As can thus be understood, the upper surface of the center rail is two thicknesses of a leg of an angle iron below the upper surface of the junction between opposite cross pieces. Since that different of two thicknesses occurs at a junction between the center rail and the cross members, it is readily apparent to the user and causes concern, not only visually to the user but physically as the box spring is added to the bed frame. It is patently obvious that the box spring will be seating on one surface, i.e the upper surface of the center rail and another surface, i.e. the upper surface of the cross members and that there is a difference of two thicknesses of a leg of the angle iron between those supporting surfaces. Thus, there is a concern by the user that the box spring will be bowed or in some way damaged by being supported by surfaces that are separated by that distance.

The result is, obviously, that there is a slight downward bow to the box spring as it sits on the cross members and the center rail separated by a fairly significant distance and which bowing is not conducive to the integrity and support of the box spring and can cause damage to that box spring.

Accordingly, it would be advantageous to have a bed frame assembly that includes a convenient and easy means of bringing the surface of the center beam up to approximately the surface of the cross members so that the box spring will not be subjected to the bowing effect and the user will be comfortable placing the box spring on those surfaces in assembling the bed.

SUMMARY OF THE INVENTION

Now, in accordance with the present invention, there is provided a snap on protective member that can easily and readily be affixed to a component of a bed frame such as a side rail or a center rail by simply snapping the protective member to that component. The snap on protective member comprises an elongated member, preferably of an extruded plastic material, and which can be affixed to a side rail or a center rail by means of having outer edges formed in the configuration of curved lips that, when assembled, extend around the outer edges of the bed frame components and also have projections formed in the elongated members adjacent or near the curved lips such that the protective members can be snapped to the bed frame components by sandwiching the outer edges of the components between the curved lips and the projections. The distance between the curved lips as they contact the bed frame component and the projections are dimensioned so as to hold those outer edges of the bed frame components therebetween so as to retain the protective members to the particular component.

There is also a further formation of ribs that extend outwardly from each elongated member and which are also dimensioned so as to contact the surface of the bed frame component when a protective member is installed in order to retain the protective member at a predetermined distance away from the bed frame component. The ribs span the distance between the protective member and the bed frame component and are dimensioned to properly position the protective member away from the bed frame components.

In one embodiment, the protective member is generally L-shaped in cross section and is adapted to be fitted to a side rail also having an L-shaped cross section to serve as protection from injuries that might be incurred by a person bumping up against the side rail. In another embodiment, the protective member is of a straight l shaped cross section so as to be fitted to the upper surface of a center rail, albeit the straight shape is curved slightly to provide sufficient flexibility to the protective member. In that case, the protective member not only provides some means of protection, but additionally is dimensioned so as to bring the upper surface of the center rail up to a level that is even, horizontally, with the upper surface of the cross members to alleviate that inherent difference between those supporting surfaces for a box spring and eliminate the normal bowing effect imparted to the box spring resting upon those surfaces.

Other features of the present protective member and bed frame using such protective member will become more apparent in light of the following detailed description of a preferred embodiment thereof and as illustrated in the accompanying drawings.

DETAILED DESCRIPTION OF THE INVENTION

Figure 1:
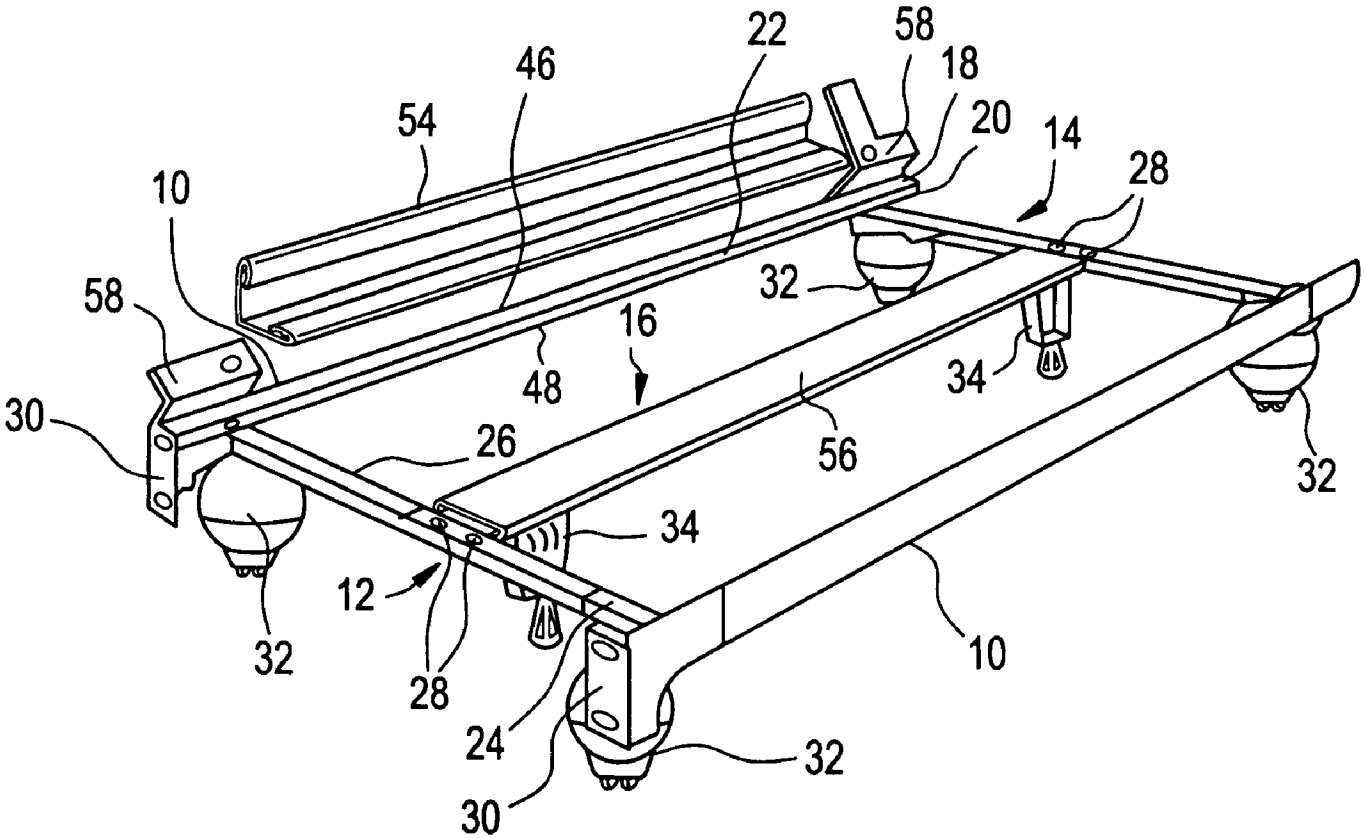
FIG. 1 is a perspective view of a bed frame with the protective member of the present invention for the side rail in an exploded view and with the protective member for the center rail in its installed condition.
Figure 2:
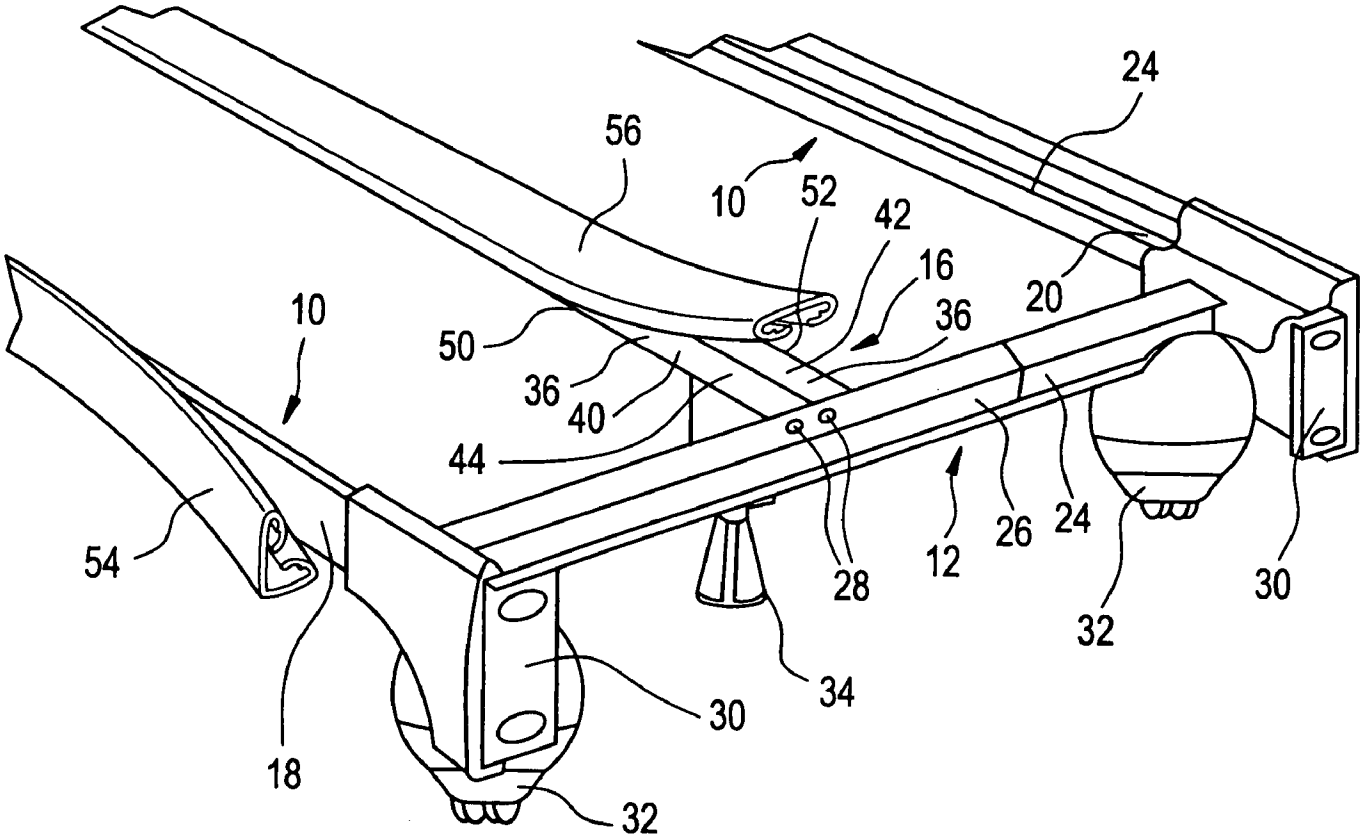
FIG. 2 is an enlarged perspective view of one end of the bed frame of FIG. 1 showing the protective members of the present invention partially removed from their installed condition.

Referring now to FIGS. 1 and 2, there are shown, a perspective view of an assembled bed frame having protective members affixed thereto in accordance with the present invention and an enlarged perspective view of the head end of the bed frame with the protective members partially removed from their installed condition. Accordingly, there are a pair of side rails 10, a head cross member 12 and a foot cross member 14. In addition, there is shown a center rail 16 that extends between and is affixed to the head cross member 12 and the foot cross member 14. In the construction of the bed frame, the side rails 10 are provided in the configuration of L-shaped angle irons having a vertical leg 18 along the exterior of the bed frame and with a horizontal leg 20 extending inwardly therefrom and, as will be seen, the horizontal leg 20 provides an upper surface 22 upon which rests a box spring when an eventual bed is assembled for use.

The head cross member 12 and the foot cross member 14 are, in turn, comprised of individual cross pieces and both the head cross member 12 and the foot cross member 14 are constructed in a similar manner. Therefore, only the description of the construction and assembly of the head cross member 12 will be explained in detail, it being noted that the foot cross member 14 is constructed and assembled in the same manner.

Thus the head cross member 12 is comprised of cross pieces 24, 26, affixed to the underside of the horizontal legs 20 of the side rails 10 and preferable are pivotally affixed thereto so as to be pivoted outwardly. As such, the cross pieces 24, 26 are, during assembly of the bed frame, joined together in an overlapping manner as will be later explained. By means of the pivoting action, the cross pieces 24, 26 can be stored and shipped in a position where they are nested within and alongside the side rails 10 and rotated to the operative position and joined together at the site where the bed frame is being assembled and which is of convenience in the storage and a shipping of bed frames.

As shown most clearly in FIG. 2, the center rail 16 is affixed to the underside of the head and foot cross members 14, 16 and can be secured thereto by means of screws 28. As such, the overall bed frame can be assembled as shown in FIGS. 1 and 2 and include other components such as head end brackets 30 that are used in securing a head board to the bed frame and legs 32 that support the corners of the bed frame. The legs 32 can be standard, conventional legs or may be the universal omnidirectional moving legs 32 shown and described in co-pending U.S. patent application Ser. No. 09519,725 entitled "Caster Assembly For A Bed Frame or Furniture" filed Mar. 3, 2000 and assigned to the present assignee and the disclosure of such specification is incorporated herein by reference. In addition, there are preferably glides 34 that extend downward from the center rail 16 to contact and be supported by the floor.

The center rail 16 comprises a pair of L-shaped angle irons 36 that are affixed together such that their vertical legs 38 (shown in FIG. 3) extend downwardly and the horizontal legs 40, 42 combine to form a double width upper surface 44 of the center rail 16. In the case of both of the components, that is, the center rail 16 and the side rails 10, there are external edges, in the case of the side rails, shown as external edges 46, 48 and as to the center rail 16, shown as external edges 50, 52.

As such, there is therefore provided, protective members, and as shown there is a side rail protective member 54 and a center rail protective member 56, both of which have common features and both of which are easily snapped onto the particular component of the bed frame so that upon assembly, the assembler can simply snap the protective members 54, 56 on to the side rails 10 and the center rail 16, respectively, to finish off the assembly of the bed frame. In FIG. 1, the side rail protective members 54 span substantially the entire length of the side rails 10, however, there are further side rail end caps 58 that are used to provide safety and protectiveness to the ends of the side rails 10. The side rail protective caps 58 can be plastic components and may have a living hinge as shown and described in co-pending U.S. patent application Ser. No. 00/000,000 entitled Bed Frame Shields filed 000,000 and assigned to the assignee of the present and the disclosure of which is incorporated into the present application be reference. Alternatively, of course, the side rail protective member 54 can span the entire length of the side rails 10.

Figure 3:
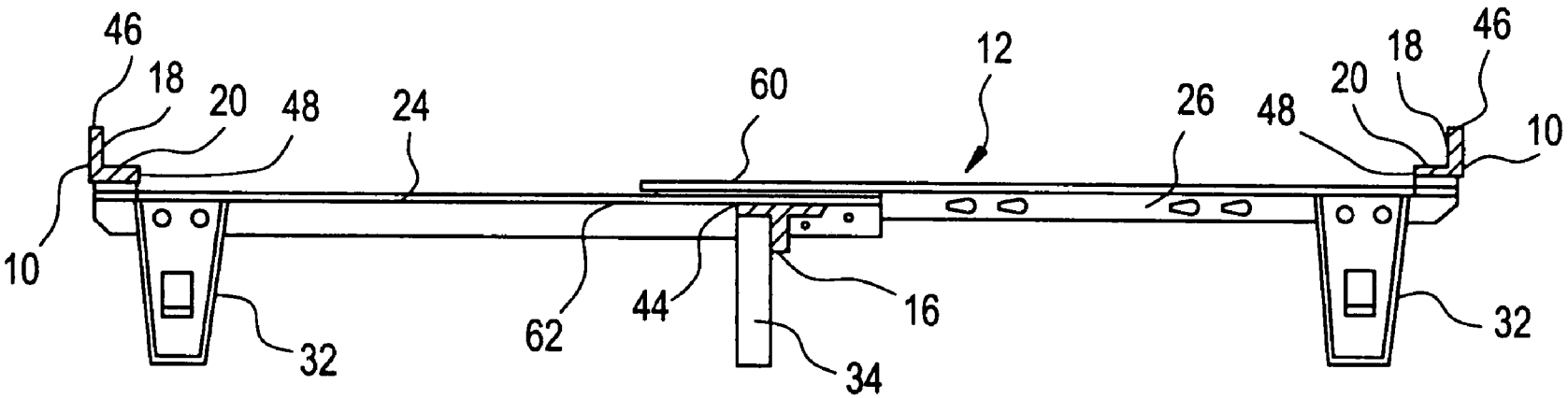
FIG. 3 is a side view, partially in cross section, of a junction of side members and center rail used with the present invention.

Turning now to FIG. 3, there is shown an end cross sectional view of a head end of a bed frame and showing a head cross member 12 affixed between the side rail 10 in order to illustrate the spatial relationship between the bed frame components. In particular, as can be seen, the cross pieces 24, 26 of the head cross member 12 overlap and are joined together to make up the head cross member 12. The end of the box spring rests upon the upper surface 60 of the head cross member 12. The box spring also rests on the upper surface 44 of the center rail 16 and that upper surface 44 is affixed to the lower surface 62 of the head cross remember 12 such that there is a space or spatial distance approximately equal to two thicknesses of a leg of an angle iron, due to the overlapping horizontal legs of the cross pieces 24, 26, between the upper surface 60 of the head cross member 12 and the upper surface 44 of the center rail 16.

Since the center rail 16 and the head cross member 14 are affixed together at that junction, the difference or space between the supporting surfaces for the box spring are obvious and can readily be visually perceived by the user who can easily recognize the disparity or spatial separation between the surfaces that support the box spring. As such, the space can cause a bowing of the box spring and cause damage to that box spring. Again as stated, the same spatial difference is present between the upper surface of the center rail 16 and the foot cross member 14 (FIG. 1) for the same reasons as explained with respect to the head cross member 12.

Figure 4:
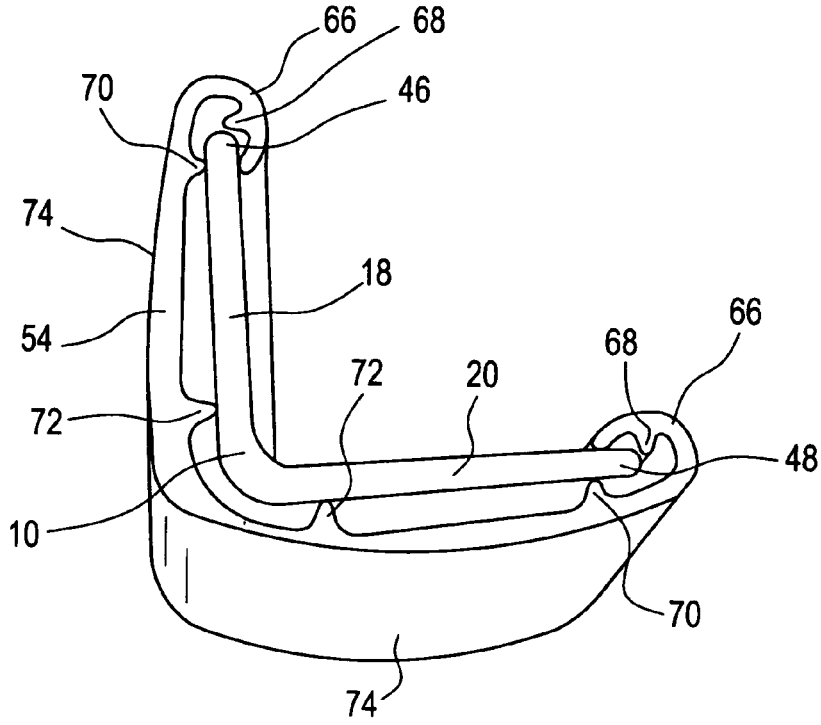
FIG. 4 is a end perspective view of the protective member of the present invention affixed to a side rail of a bed frame.

Turning now to FIG. 4, taken along with FIGS. 1 and 2, there is shown an end perspective view of a side rail protective member 54 constructed in accordance with the present invention and in position affixed to a side rail 10. In FIG. 4, the protective member 54 is an L-shaped cross sectional configuration so as to fit over and partially surround the side rail 10 that, as explained, is also an L-shaped cross section and the protective member 54 is snap fitted to the side rail 10 so as to cover or partially surround the external edges 46, 48 of the horizontal leg 20 and the vertical leg 18 of side rail 10 to provide the protection against possible injury to a user striking either of the flat surfaces or the edges of a side rail 10. While the cross section of the side rail protective member 54 is described herein as generally L-shaped, in actuality there is a slight curvature or bow to the sides of the L-shaped configuration and which bow assists in providing the flexibly to enable the side rail protective members 54 to snap onto the side rails 10. The elongated member, as has been explained, extends at least substantially along the entire length of the side rails 10 and the center rail 16. The material is preferable extruded polyethylene, however, other plastic compositions can be used, including polyvinyl chloride.

In FIG. 4, the side rail protective member 54 has two external edges formed as curved lips 66 that, when installed, surround the external edges 46, 48 of the side rails 10 to provide protection by covering those exterior edges. In the FIG. 4 embodiment, the curved lips 66 include inwardly directed stubs 68 that engage the leg of a side rail 10 and also there are formed inwardly extending projections 70. As can be seen, the side rail leg, be it the horizontal leg 20 or the vertical leg 18 is captured or sandwiched between the curved lips 66 via the stubs 68 and the inwardly extending projections 70 such that those curved lips 66 can be snapped over the external edges of the side rail 10 and hold the side rail protective member 54 to the side rails 10 by means of the sandwiching and forceful holding of the legs of the side rail therebetween. The inherent flexibility of the side rail protective member 54 enables the user to snap the side rail protective member 54 to the side rail 10 easily and yet in a stable affixation so that the side rail protective member 54 does not come loose during the normal movement and use of the bed frame.

In addition, in FIG. 4 there can be seen a plurality of ribs 72 that are formed in the elongated member and which extend inwardly so as to contact the outside surfaces of the vertical leg 18 and the horizontal leg 20 of the side rails 10 when the side rail protective member 54 is affixed thereto. The ribs 72 are of a predetermined length and position the external surface 74 of the side rail protective member 54 at a specific designed distance away from the outside surfaces of the vertical and horizontal legs 18, 20 of the side rails 10 such that there is some give when encountered or struck by a user so as to cushion the blow to minimize the injury to that user. In addition, the presence of the ribs 72 allow the protective member to be extruded of a relatively thin but uniform cross section since the ribs also provide a stiffening of the protective members as well as space the protective members away from the side rail 10 or center rail 16

Figure 5:
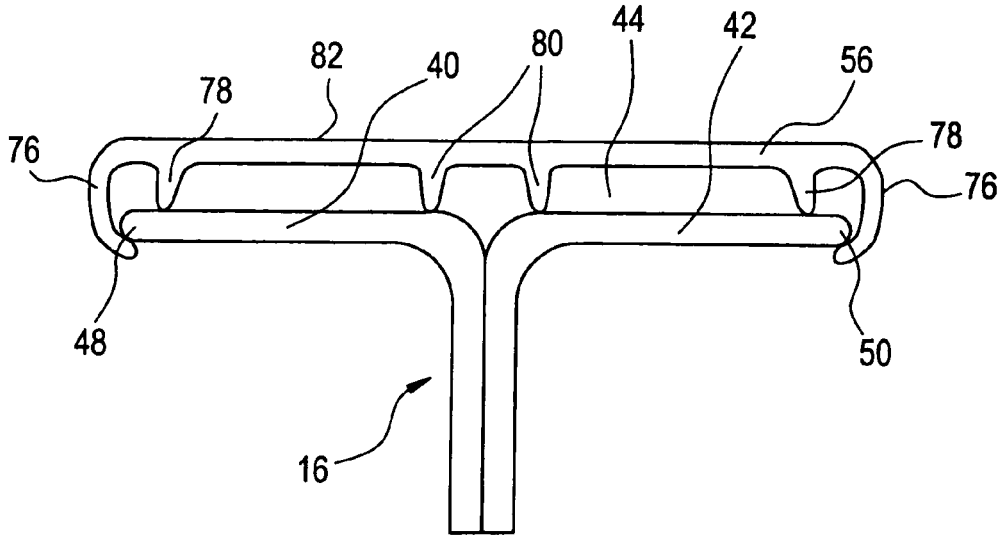
FIG. 5 is an end perspective view of the protective member of the present invention affixed to a center rail of a bed frame.

Turning now to FIG. 5, there is shown an end perspective view of a center rail protective member 56, affixed to a center rail 16. The overall cross section of the center rail protective member 56 is generally in the shape of an l, however, in fact, the cross section is slightly curved so that there is a certain give and flexibility to enable the center rail protective member 56 to be snap fitted the center rail 16. Again, as with the FIG. 4 embodiment, there are exterior edges formed in the shape of curved lips 76 that are formed and which are configured so as to at least partially encircle the external edges 48, 50 of the center rail 16 to aid in holding the center rail protective member 56 in its position snapped to the center rail 16. Also, there are inwardly directed projections 78 that act in conjunction with the curved lips 76 so as to sandwich the horizontal legs 40, 42 of the center rail 16 therebetween to retain the center rail protective member 56 securely to the center rail 16 when snapped on to that component by the user. In addition there are a plurality of ribs 80 formed in the interior surface of the center rail protective member 16 and which serve to locate the external surface 82 of the center rail protective member 56 in a predetermined position with respect to the upper surface 44 of the center rail 16.

Again the horizontal legs 40, 42 of the center rail 16 are sandwiched between the curved lips 76 and the inwardly directed projections 78 to retain the center rail protective member 56 to the center rail 16 and the center rail protective member 56 is spaced away from the center rail 16 by means of the ribs 80 that are specially sized so as to make up two thicknesses of a leg of a L-shaped angle iron so that, as explained, a box spring that rests upon the bed frame can rest on the head and foot cross members 12, 14 (FIG. 1) and which are at the same level as the external surface 82 of the center rail protective member 56 so that there is no bow created in that box spring.

While the present invention has been set forth in terms of a specific embodiment of embodiments, it will be understood that the present protective members for bed frame components herein disclosed may be modified or altered by those skilled in the art to other configurations. Accordingly, the invention is to be broadly construed and limited only by the scope and spirit of the claims appended hereto.

The invention claimed is:

1. A snap on protective member adapted to be affixed to a bed frame component having exterior edges and opposite facing surfaces, said snap on member comprising an elongated member that is generally l-shaped in cross section and having outside edges, each of said outside edges having a lip adapted to fit around an exterior edge of the bed frame component to contact one of the opposite facing surfaces, and a projection formed in said elongated member adjacent to said lip to contact the other of the opposite facing surfaces to sandwich the exterior edges of said bed frame component between said lip and said projection to hold said elongated member to said bed frame component.

2. A snap on protective member as defined in claim 1 wherein said lip is a curved lip.

3. A snap on protective member as defined in claim 1 wherein said elongated member includes a plurality of ribs extending outwardly from the elongated member to locate an external surface of the elongated member at a predetermined distance away from said bed frame component.

4. A snap on protective member as defined in claim 3 wherein said plurality of ribs are adapted to contact said bed frame component to position an external surface a predetermined distance away from said bed frame component.

5. A snap on protective member as defined in claim 1 wherein the generally l-shaped cross section is slightly curved.

6. A snap on protective member as defined in claim 1 wherein said elongated member is an extruded polyethylene.

7. A method of protecting a bed frame component having exterior edges and opposite facing surfaces, said method comprising the steps of:

providing an elongated member having a slightly curved l-shaped cross section and having outside edges formed as curved lips and having at least one projection, snap fitting the elongated member onto the bed frame component by forcing the curved lips to at least partially surround the exterior edges of the bed frame component such that the curved lips contact one of the opposite facing surfaces and the at least one projection contacts the other opposite facing surface to sandwich the exterior edges of the bed frame component between the curved lips and the at least one projection.

8. A method as defined in claim 7 wherein said step of providing an elongated member comprises providing an extruded plastic elongated member.

9. A bed frame assembly having bed frame components comprising side rails, cross members interconnecting said side rails, and a center rail affixed to said cross members and oriented generally parallel to said side rails, an elongated snap on member affixed at least substantially along the length of at least one of said bed frame components having exterior edges and opposite facing surfaces, said elongated member having a slightly curved l-shaped cross section and having opposite edges, each of said opposite edges having a curved lip adapted to fit over an exterior edge of the bed frame component and contact one of the opposite facing surfaces and a projection formed in said elongated member adjacent to said curved lip to contact the other of the opposite facing surfaces to sandwich said exterior edges of said bed frame component between said curved lip and said at least one projection to hold said elongated member to said bed frame component.

10. A bed frame assembly as defined in claim 9 wherein said elongated member includes at least one rib extending from a surface of the elongated member so as to hold the elongated member at a predetermined distance away from said bed frame component.

11. A bed frame assembly as defined in claim 10 wherein said at least one rib comprises a plurality of ribs extending outwardly from said surface adapted to contact the bed frame component.

12. A bed frame assembly as defined in claim 10 wherein said cross members have an upper surface, and wherein said at least one rib is of predetermined dimensions to form an upper surface of said elongated member substantially even with the upper surface of said cross members.

13. A bed frame assembly as defined in claim 12 wherein said at least one rib comprises a plurality of ribs that extend downwardly from said elongated member so as to contact said bed frame component.

* * * * *